US010123664B2

(12) United States Patent
Jones

(10) Patent No.: US 10,123,664 B2
(45) Date of Patent: Nov. 13, 2018

(54) MOUNTING SYSTEM FOR ACCESSORY

(71) Applicant: Moen Incorporated, North Olmsted, OH (US)

(72) Inventor: Kyle Clancy Jones, Avon, OH (US)

(73) Assignee: Moen Incorporated, North Olmsted, OH (US)

( * ) Notice: Subject to any disclaimer, the term of this patent is extended or adjusted under 35 U.S.C. 154(b) by 0 days.

(21) Appl. No.: 15/786,898

(22) Filed: Oct. 18, 2017

(65) Prior Publication Data

US 2018/0103809 A1 Apr. 19, 2018

Related U.S. Application Data

(60) Provisional application No. 62/409,605, filed on Oct. 18, 2016.

(51) Int. Cl.

| | |
|---|---|
| ***A47B 96/00*** | (2006.01) |
| ***A47K 10/10*** | (2006.01) |
| ***A47B 96/06*** | (2006.01) |

(52) U.S. Cl.

CPC ..... *A47K 10/10* (2013.01); *A47B 96/068* (2013.01); *A47K 2201/02* (2013.01)

(58) Field of Classification Search

CPC ..... A47H 1/122; A47H 1/142; A47H 1/022; A47K 10/10; A47B 96/068

USPC ..... 248/221.11; 211/119.009

See application file for complete search history.

(56) References Cited

U.S. PATENT DOCUMENTS

| | | | |
|---|---|---|---|
| 3,036,803 | A | 5/1962 | Fiebelkorn |
| 4,498,654 | A | 2/1985 | Cooper |
| 4,718,625 | A | 1/1988 | Boda |
| 5,799,804 | A | 9/1998 | Shame |

(Continued)

OTHER PUBLICATIONS

Author unknown, Delta Quick Click, installation video and installation guide, the installation video is believed to have been publicly available as of Jul. 22, 2013 and the installation guide is believed to have been publicly available as of Jul. 17, 2013 (2 pages installation video and 2 pages installation guide).

(Continued)

*Primary Examiner* — Todd M Epps
(74) *Attorney, Agent, or Firm* — Calfee, Halter & Griswold LLP

(57) ABSTRACT

The present invention provides a mounting system for an accessory that enables a consumer to easily install and uninstall the accessory on a mounting surface. The accessory mounting system includes a post and a mounting assembly. The mounting assembly includes a first mounting subassembly and a second mounting subassembly. The first mounting subassembly includes a deflectable member. The second mounting subassembly includes a set screw. The post is operable to be attached to the mounting surface by an engagement of the first mounting subassembly with the post and a snap engagement of the deflectable member of the first mounting subassembly with the second mounting subassembly. The post is operable to be removed from the mounting surface by unthreading the set screw and disengagement of the deflectable member of the first mounting subassembly with the second mounting subassembly and disengagement of the first mounting subassembly with the post.

20 Claims, 12 Drawing Sheets

(56) References Cited

U.S. PATENT DOCUMENTS

| | | | | |
|---|---|---|---|---|
| 6,520,463 | B1 | 2/2003 | Ouano | |
| 7,641,161 | B2 | 1/2010 | Bauer | |
| 8,382,051 | B2 | 2/2013 | Smith | |
| 8,430,369 | B2 | 4/2013 | Hsu et al. | |
| 8,646,626 | B2 * | 2/2014 | Hsu | A47K 10/10 211/119.009 |
| 8,973,878 | B2 * | 3/2015 | Thompson | A47G 1/175 248/221.11 |
| 9,307,124 | B2 * | 4/2016 | Chen | F16M 13/02 |
| 2005/0236538 | A1 | 10/2005 | Schmidt et al. | |
| 2008/0029665 | A1 | 2/2008 | Bauer | |
| 2009/0108157 | A1 | 4/2009 | Spencer | |
| 2012/0067837 | A1 | 3/2012 | He et al. | |
| 2013/0228660 | A1 | 9/2013 | Cen | |
| 2014/0026392 | A1 | 1/2014 | Austin, III et al. | |

OTHER PUBLICATIONS

Author unknown, Delta EasyClip, installation video and installation guide, the installation video is believed to have been publicly available as of Mar. 23, 2011 and the installation guide is believed to have been publicly available as of Jun. 3, 2011 (2 pages installation video and 2 pages installation guide).

Author unknown, Pfister ClickLock, installation video and installation guide, the installation video is believed to have been publicly available as of Jan. 28, 2016 and the installation guide is believed to have been publicly available as of May 8, 2015 (2 pages installation video and 6 pages installation guide).

* cited by examiner 12
46
32

36
44
44
50
48
48
50
34

12
3h
38
40
3h 30
12
28
3j
3j 12
28
30
46

3i
32
38
40
12
3i

MOUNTING SYSTEM FOR ACCESSORY

CROSS-REFERENCE TO RELATED APPLICATION

This application claims the benefit of U.S. Provisional Application No. 62/409,605, filed Oct. 18, 2016, the entire disclosure of which is hereby incorporated by reference.

FIELD

The present invention relates generally to a mounting system for an accessory and, more particularly, to a mounting system for an accessory that enables a consumer to easily install and uninstall the accessory on a mounting surface.

BACKGROUND

Systems for installing bathroom, kitchen, and laundry accessories (e.g., towel bars, towel rings, toilet paper holders, and robe hooks) are known. Consumers desire a system that enables them to easily install and uninstall an accessory. Some systems enable a consumer to easily install an accessory by snapping the accessory onto a bracket attached to a mounting surface. However, these systems do not enable the consumer to easily uninstall the accessory once installed, and may even damage the mounting surface when the accessory is uninstalled.

SUMMARY

The present invention provides a mounting system for an accessory that enables a consumer to easily install and uninstall the accessory on a mounting surface.

In an exemplary embodiment, the accessory mounting system includes a post and a mounting assembly. The post is operable to be installed on a mounting surface. The post includes a rear opening and a first set screw opening. The mounting assembly is operable to be received in the rear opening in the post. The mounting assembly includes a first mounting subassembly and a second mounting subassembly. The first mounting subassembly includes a deflectable member. The second mounting subassembly includes a set screw. The second mounting subassembly is operable to be secured to the post by threading the set screw through the first set screw opening and into the rear opening in the post. The first mounting subassembly is operable to be attached to the mounting surface. The post is operable to be attached to the mounting surface by an engagement of the first mounting subassembly with the post and a snap engagement of the deflectable member of the first mounting subassembly with the second mounting subassembly. The post is operable to be removed from the mounting surface by unthreading the set screw and disengagement of the deflectable member of the first mounting subassembly with the second mounting subassembly and disengagement of the first mounting subassembly with the post.

In an exemplary embodiment, the accessory mounting system includes a post and a mounting assembly. The post is operable to be installed on a mounting surface. The post includes a rear opening, a rear inner surface, and a first set screw opening. The mounting assembly is operable to be received in the rear opening in the post. The mounting assembly includes a first mounting subassembly and a second mounting subassembly. The first mounting subassembly includes a bracket. The bracket includes a base plate and a deflectable member. The second mounting subassembly includes a set screw. The set screw is operable to be threaded through the first set screw opening in the post and into the rear opening in the post. The bracket is operable to be attached to the mounting surface. The post is operable to be attached to the mounting surface by an engagement of the bracket with the post and a snap engagement of the deflectable member of the bracket with the second mounting subassembly. The post is operable to be removed from the mounting surface by unthreading the set screw and disengagement of the deflectable member of the bracket with the second mounting subassembly and disengagement of the bracket with the post.

In an exemplary embodiment, the accessory mounting system includes a post and a mounting assembly. The post is operable to be installed on a mounting surface. The post includes a rear opening, a rear inner surface, a notch in the rear inner surface, and a first set screw opening. The mounting assembly is operable to be received in the rear opening in the post. The mounting assembly includes a first mounting subassembly and a second mounting subassembly. The first mounting subassembly includes a bracket. The bracket includes a base plate, a rim, and a finger. The second mounting subassembly includes a brace and a set screw. The brace includes a second set screw opening. The set screw is operable to be threaded through the first set screw opening in the post and into the rear opening in the post. The brace is operable to be secured to the post by threading the set screw into the second set screw opening in the brace. The bracket is operable to be attached to the mounting surface. The post is operable to be attached to the mounting surface by an engagement of the rim of the bracket with the notch in the rear inner surface of the post and a snap engagement of the finger of the bracket with the brace. The post is operable to be removed from the mounting surface by unthreading the set screw and disengagement of the finger of the bracket with the brace and disengagement of the rim of the bracket with the notch in the rear inner surface of the post.

BRIEF DESCRIPTION OF THE DRAWINGS

-FIG. 3*a* is a perspective view, FIG. 3*b* is a front view, FIG. 3*c* is a rear view, FIG. 3*d* is a top view, FIG. 3*e* is a bottom view, FIG. 3*f* is a left view, FIG. 3*g* is a right view, FIG. 3*h* is a cross-sectional view taken along the line 3*h*-3*h* in FIG. 3*g*, FIG. 3*i* is a cross-sectional view taken along the line 3*i*-3*i* in FIG. 3*f*, and FIG. 3*j* is a cross-sectional view taken along the line 3*j*-3*j* in FIG. 3*b;*

-FIG. 4*a* is a perspective view, FIG. 4*b* is a front view, FIG. 4*c* is a rear view, FIG. 4*d* is a top view, FIG. 4*e* is a bottom view, FIG. 4*f* is a left view, and FIG. 4*g* is a right view;

-FIG. 5*a* is a perspective view, FIG. 5*b* is a front view, FIG. 5*c* is a rear view, FIG. 5*d* is a top view, FIG. 5*e* is a bottom view, FIG. 5*f* is a left view, and FIG. 5*g* is a right view; -FIG. 6*a* is a side cross-sectional view showing the brace retained in the post with the set screw and the bracket in a position it would be in when attached to a mounting surface, FIG. 6*b* is a side cross-sectional view showing the bracket starting to engage the post and the brace, FIG. 6*c* is a side cross-sectional view showing the bracket further engaging the post and the brace, and FIG. 6*d* is a side cross-sectional view showing the bracket completely engaging the post and the brace.

DETAILED DESCRIPTION

The present invention provides a mounting system for an accessory that enables a consumer to easily install and uninstall the accessory on a mounting surface. The installation involves engaging a snap feature, so that the accessory can be easily attached to the mounting surface. The uninstallation involves disengaging the snap feature, so that the accessory can be easily removed from the mounting surface without damaging the mounting surface.

In an exemplary embodiment, the accessory is a towel bar. However, one of ordinary skill in the art will appreciate that the accessory could be a towel ring, a toilet paper holder, a robe hook, or any other accessory.

Figure 1:
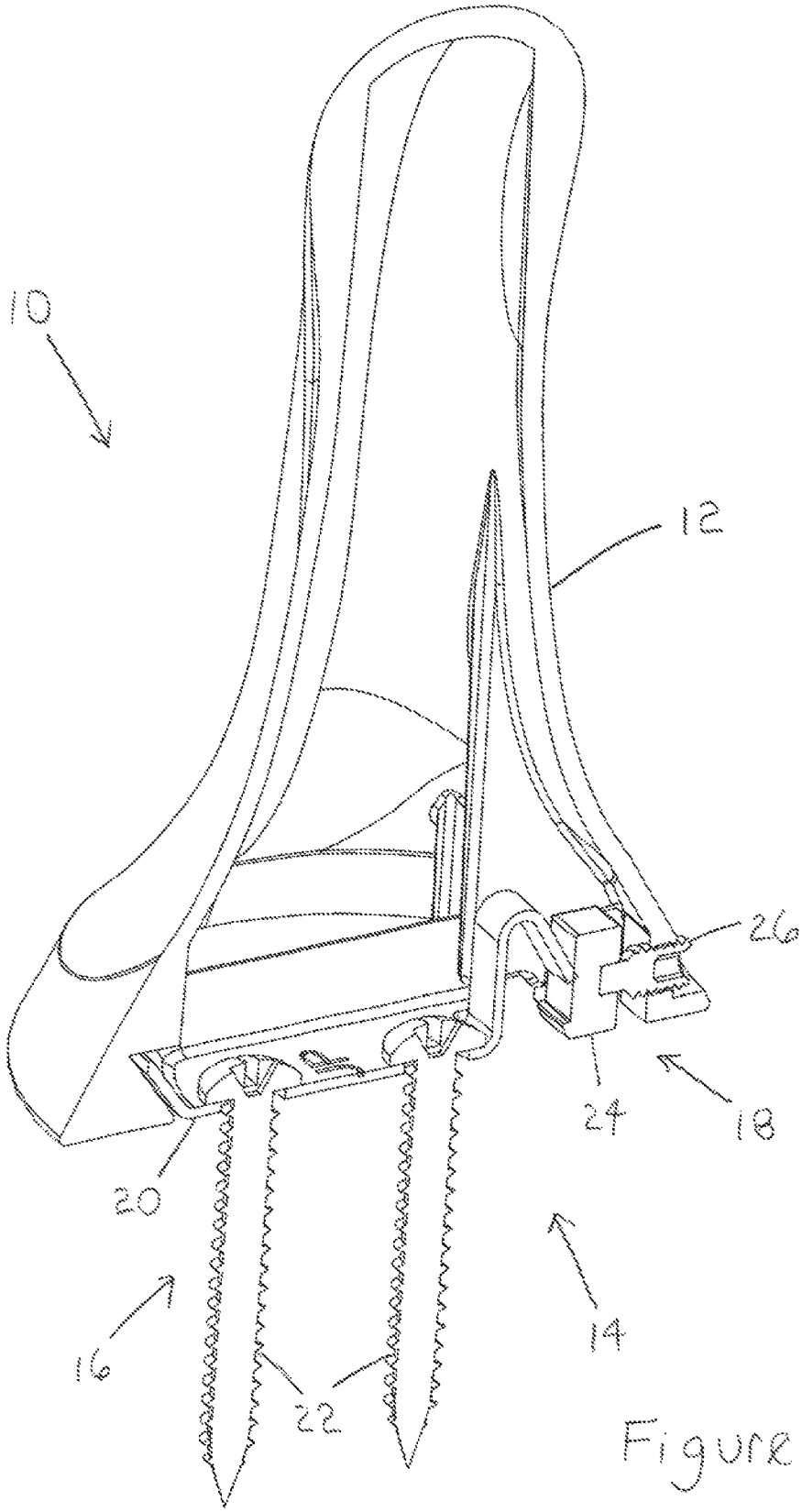
FIG. 1 is a partial cross-sectional perspective view of an accessory mounting system according to an exemplary embodiment of the present invention, the accessory mounting system including a post, a bracket, a brace, and a set screw.
Figure 2:
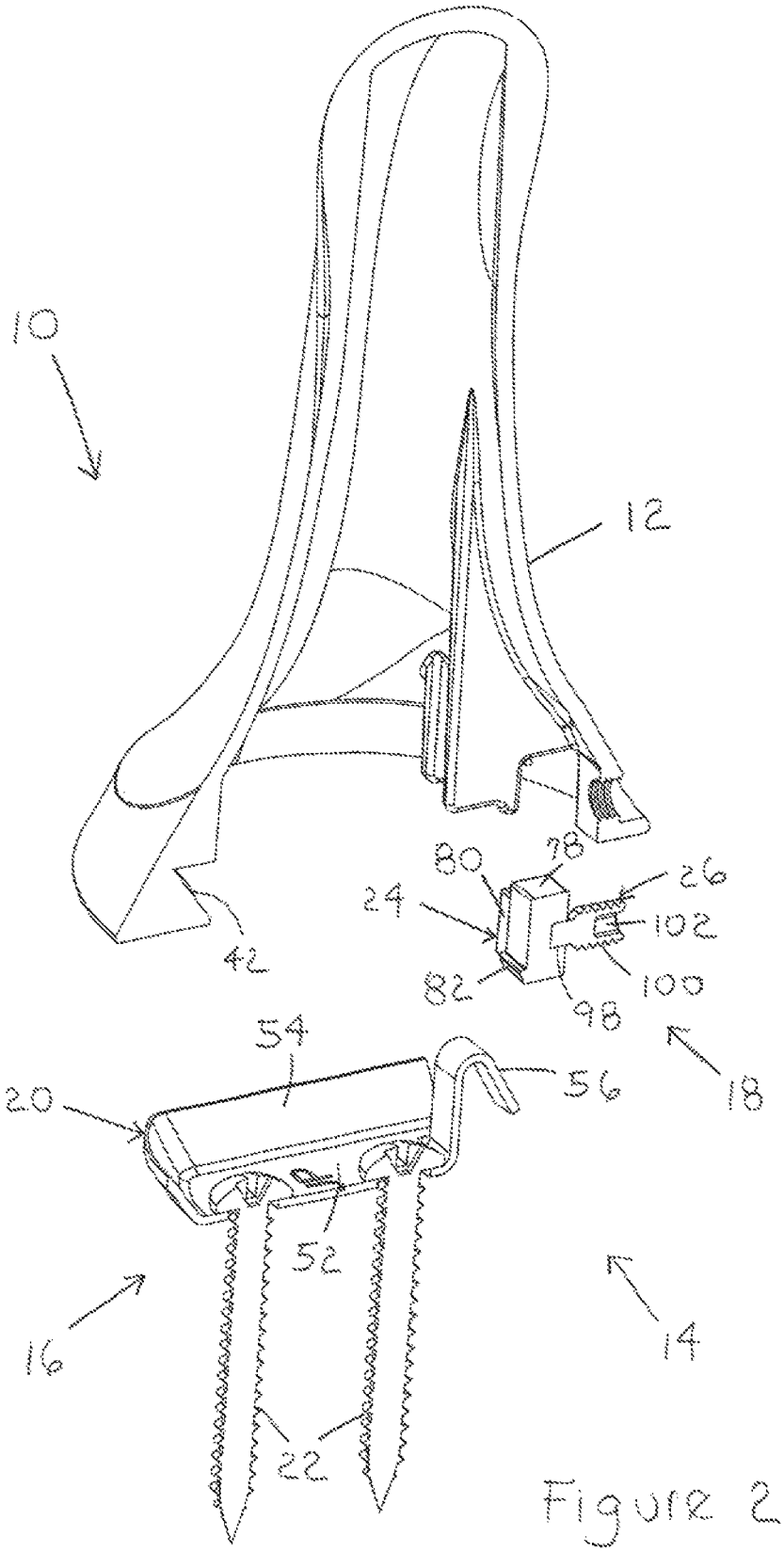
FIG. 2 is a partial exploded perspective view of the accessory mounting system of FIG. 1.
Figures 3A, 3B, 3C, 3D, 3E, 3F, 3G:
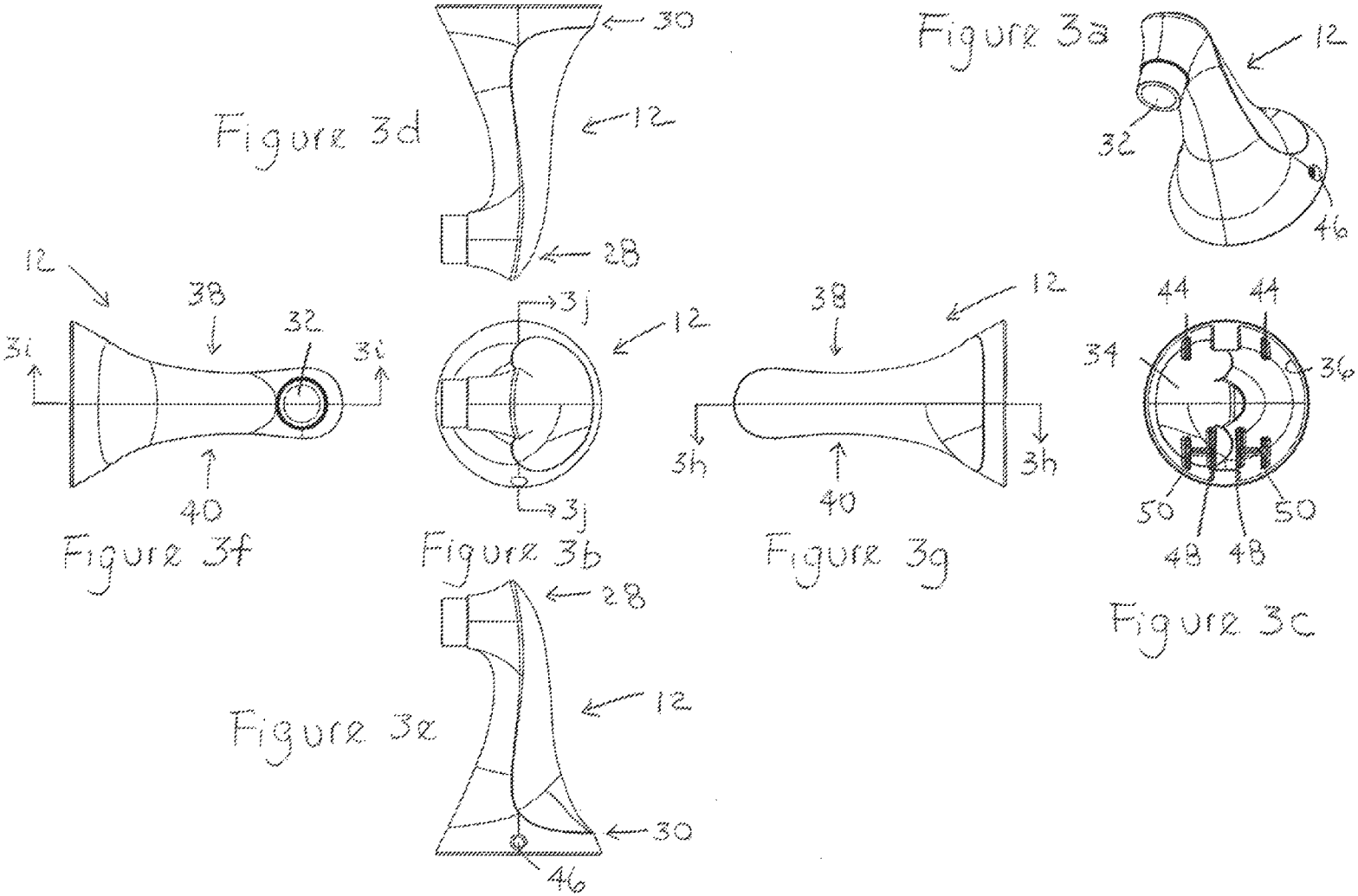
FIGS. 3*a*-3*j* are views of the post of the accessory mounting system of FIG. 1
Figure 3H:
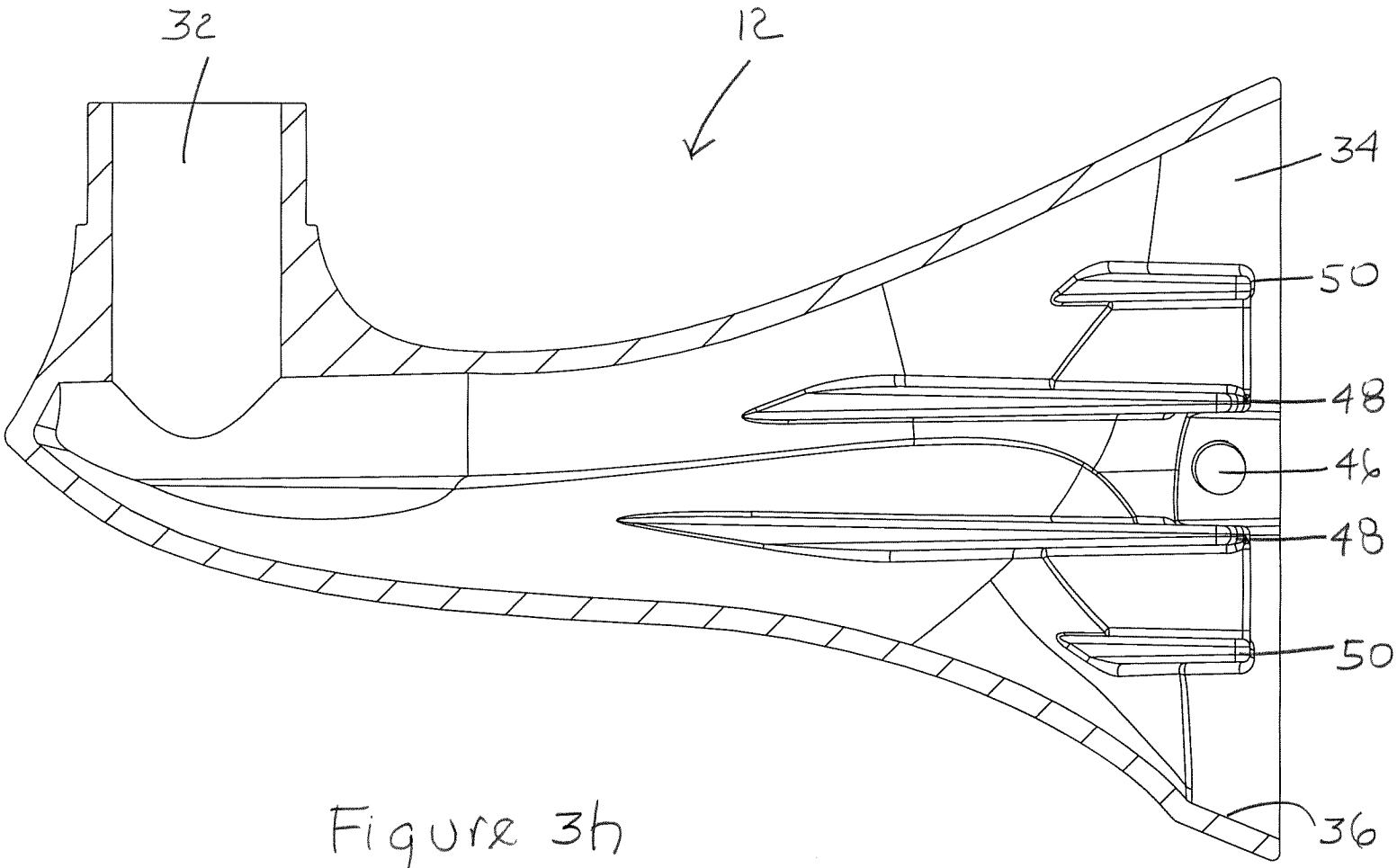
Figure 3I:
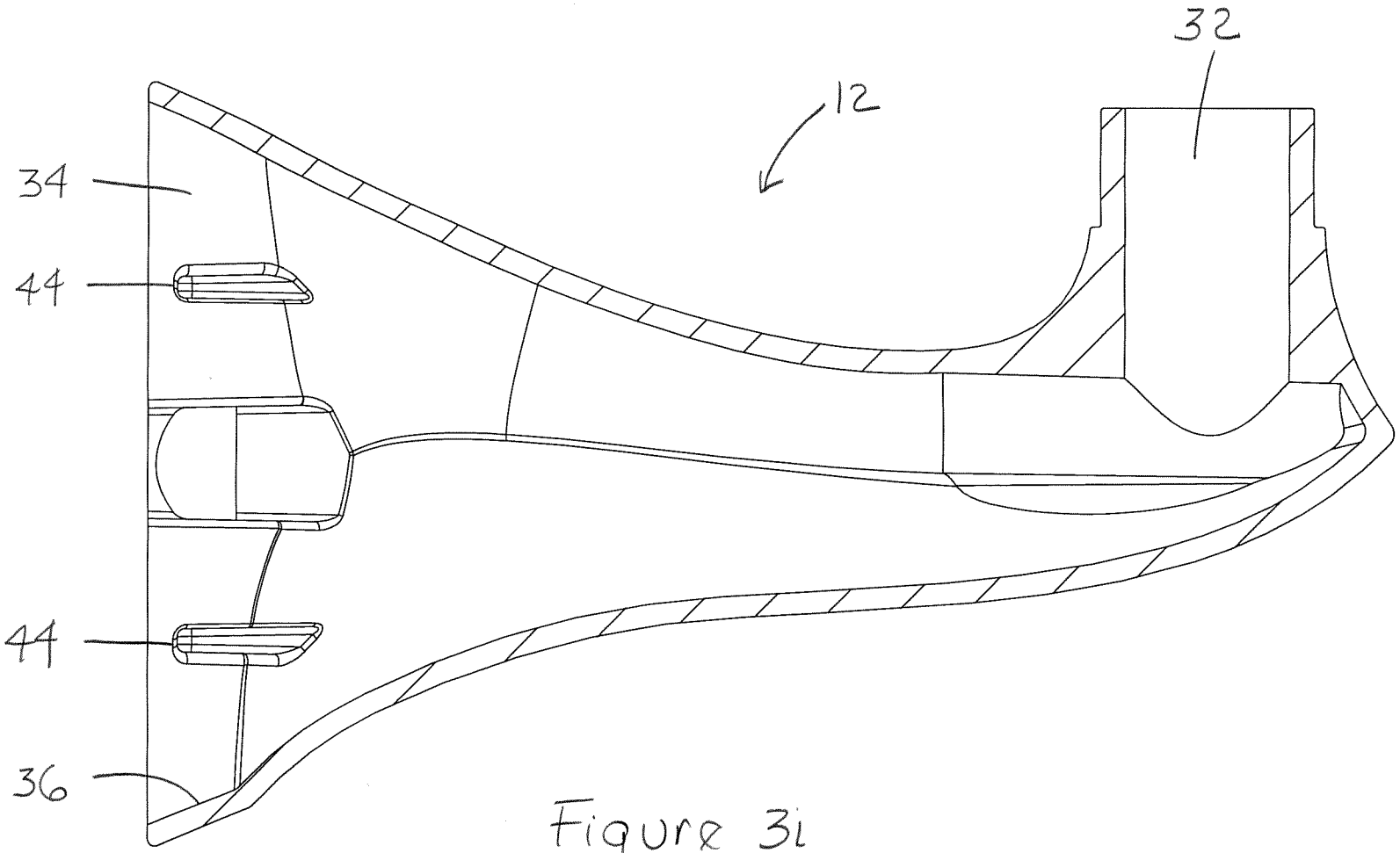
Figure 3J:
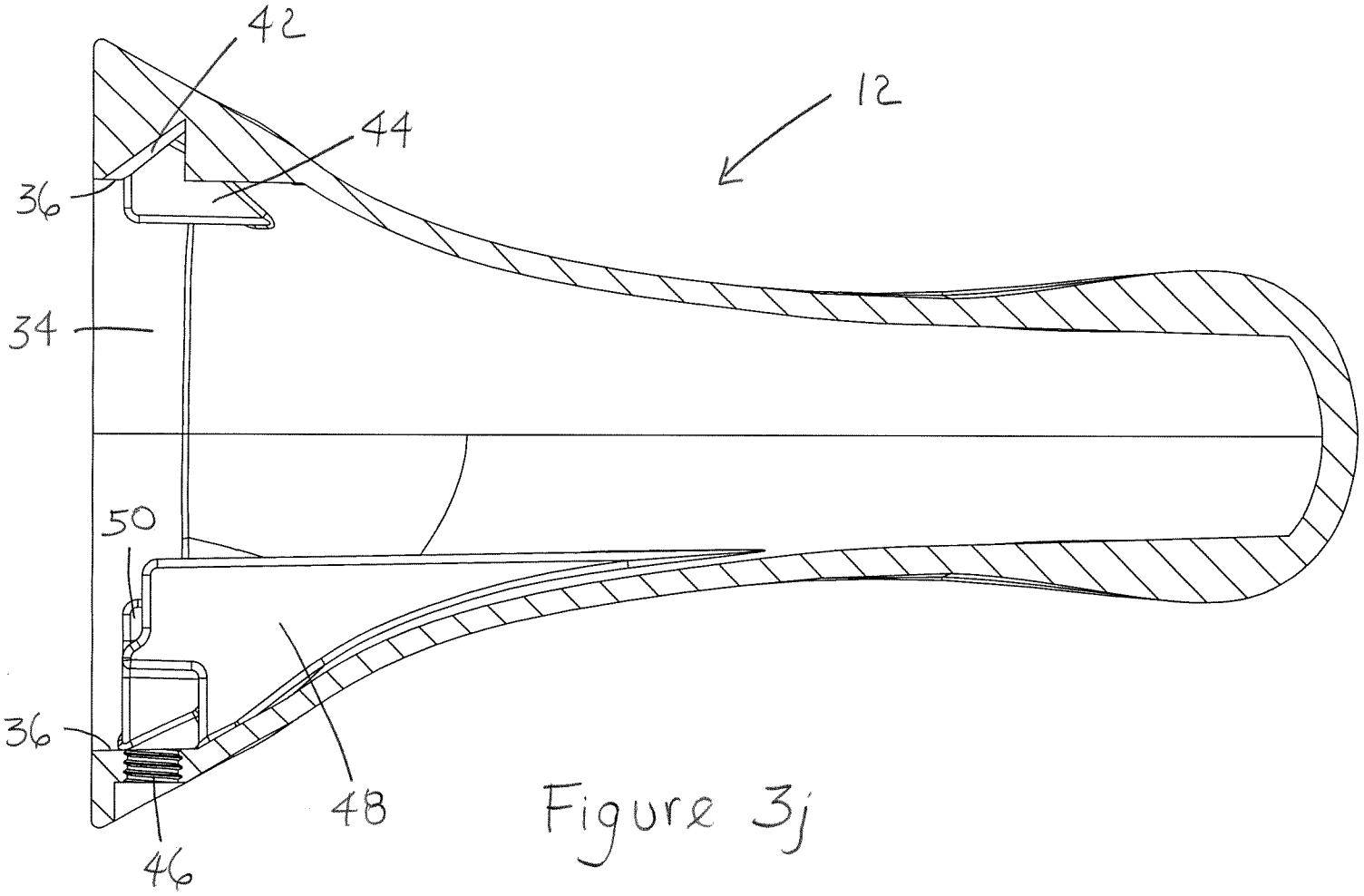
Figures 4A, 4B, 4C, 4D, 4E, 4F, 4G:
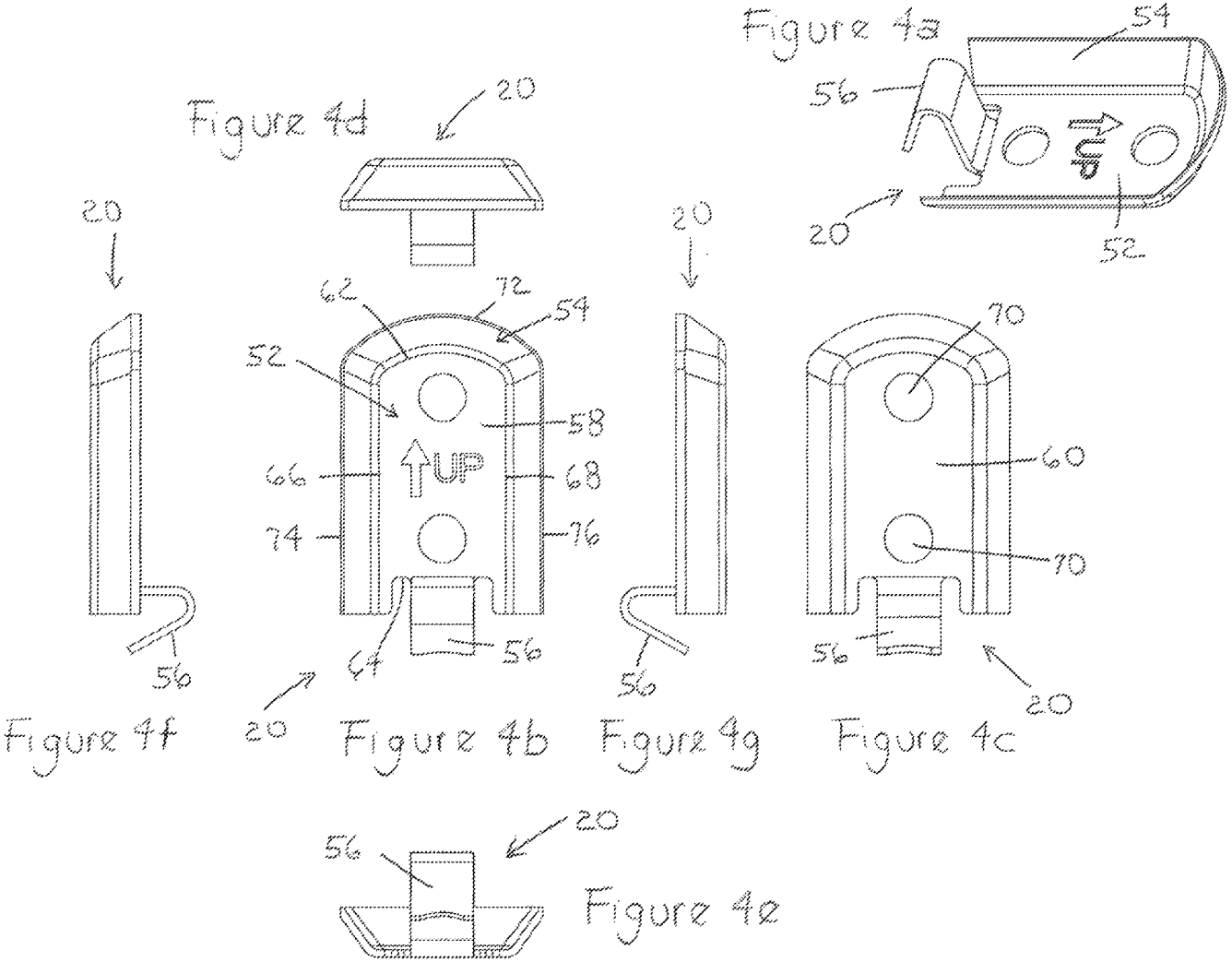
FIGS. 4*a*-4*g* are views of the bracket of the accessory mounting system of FIG. 1
Figures 5A, 5B, 5C, 5D, 5E, 5F, 5G:
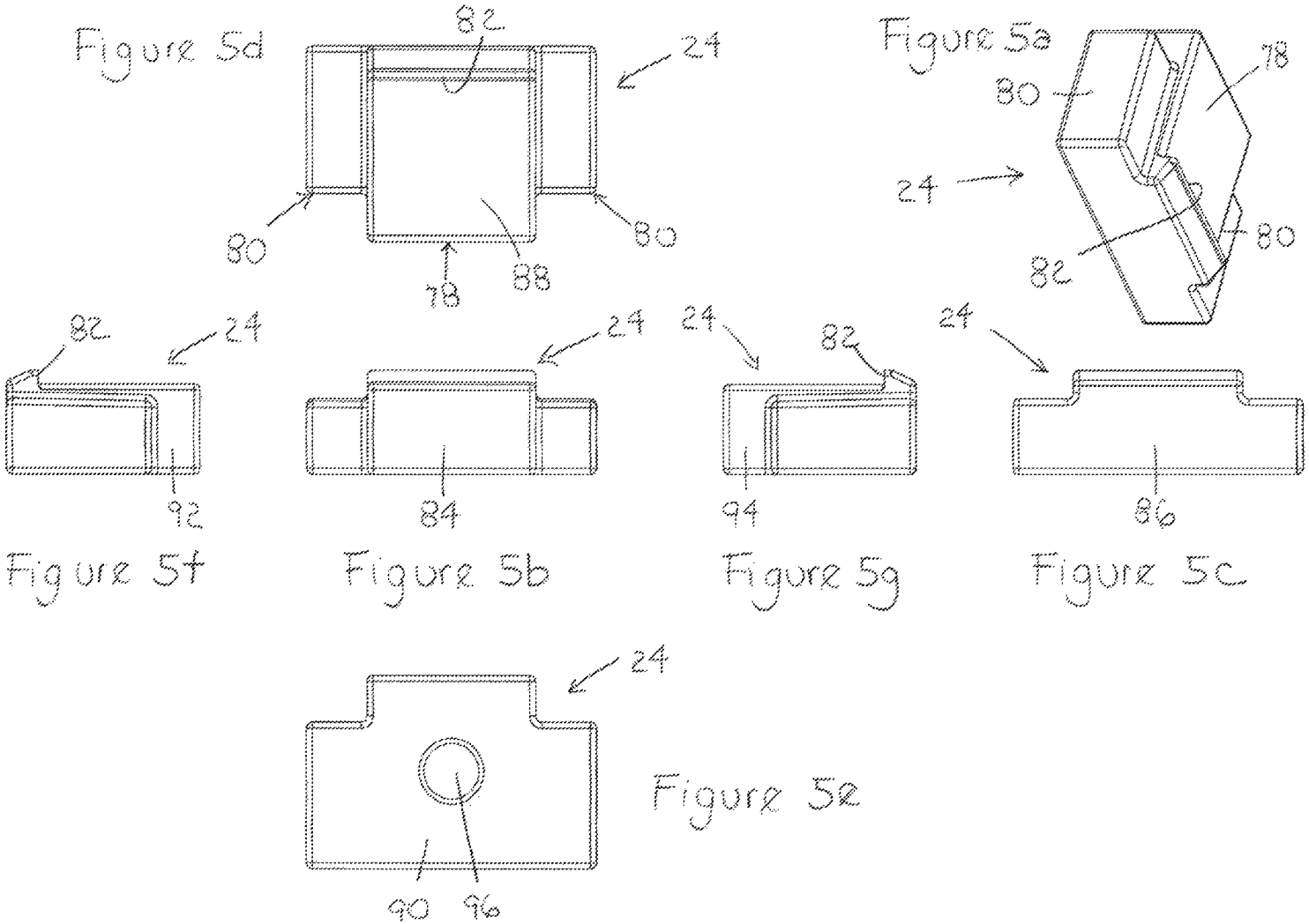
FIGS. 5*a*-5*g* are views of the brace of the accessory mounting system of FIG. 1
Figure 6A:
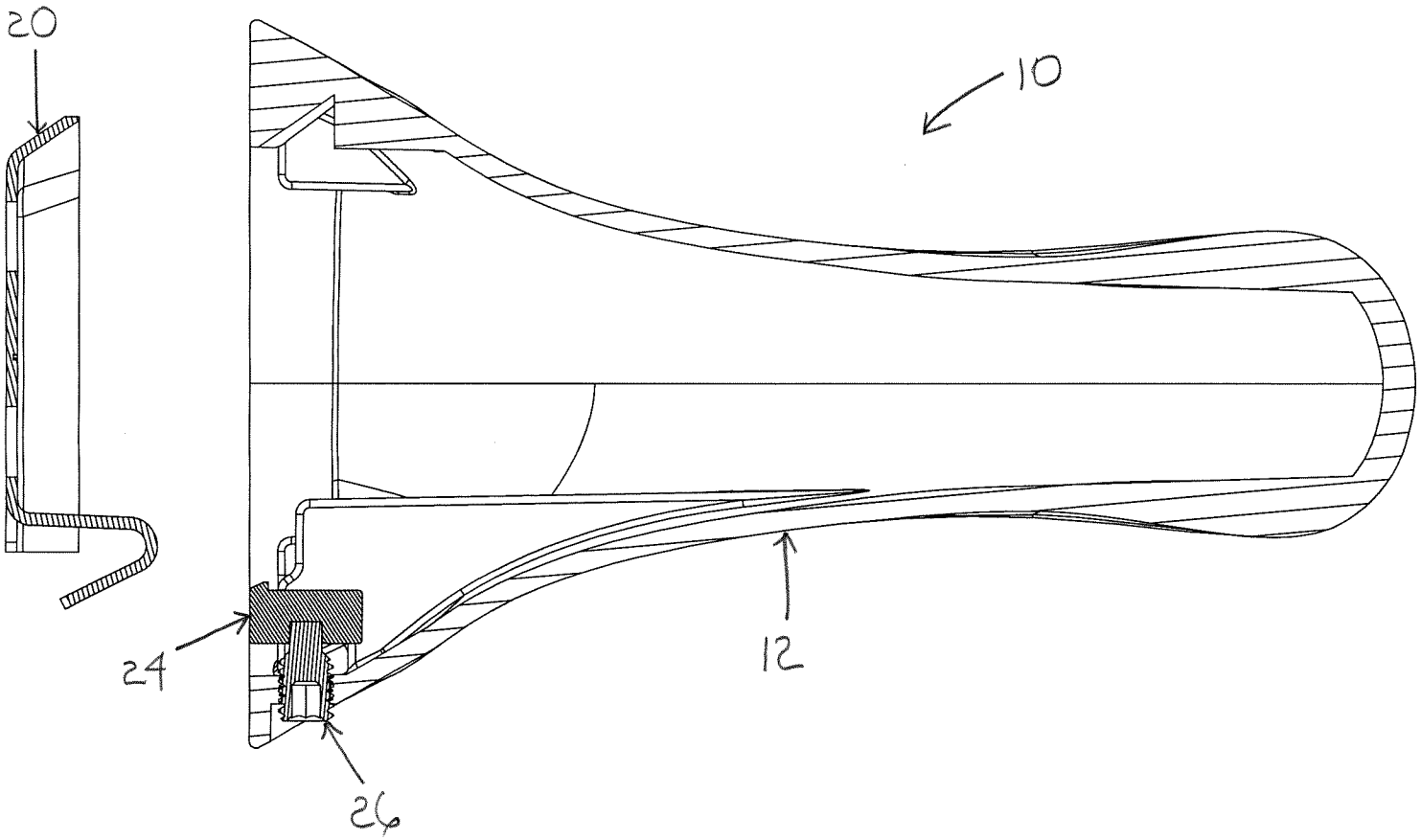
FIGS. 6*a*-6*d* are views illustrating assembly and installation of the post using the accessory mounting system of FIG. 1
Figure 6B:
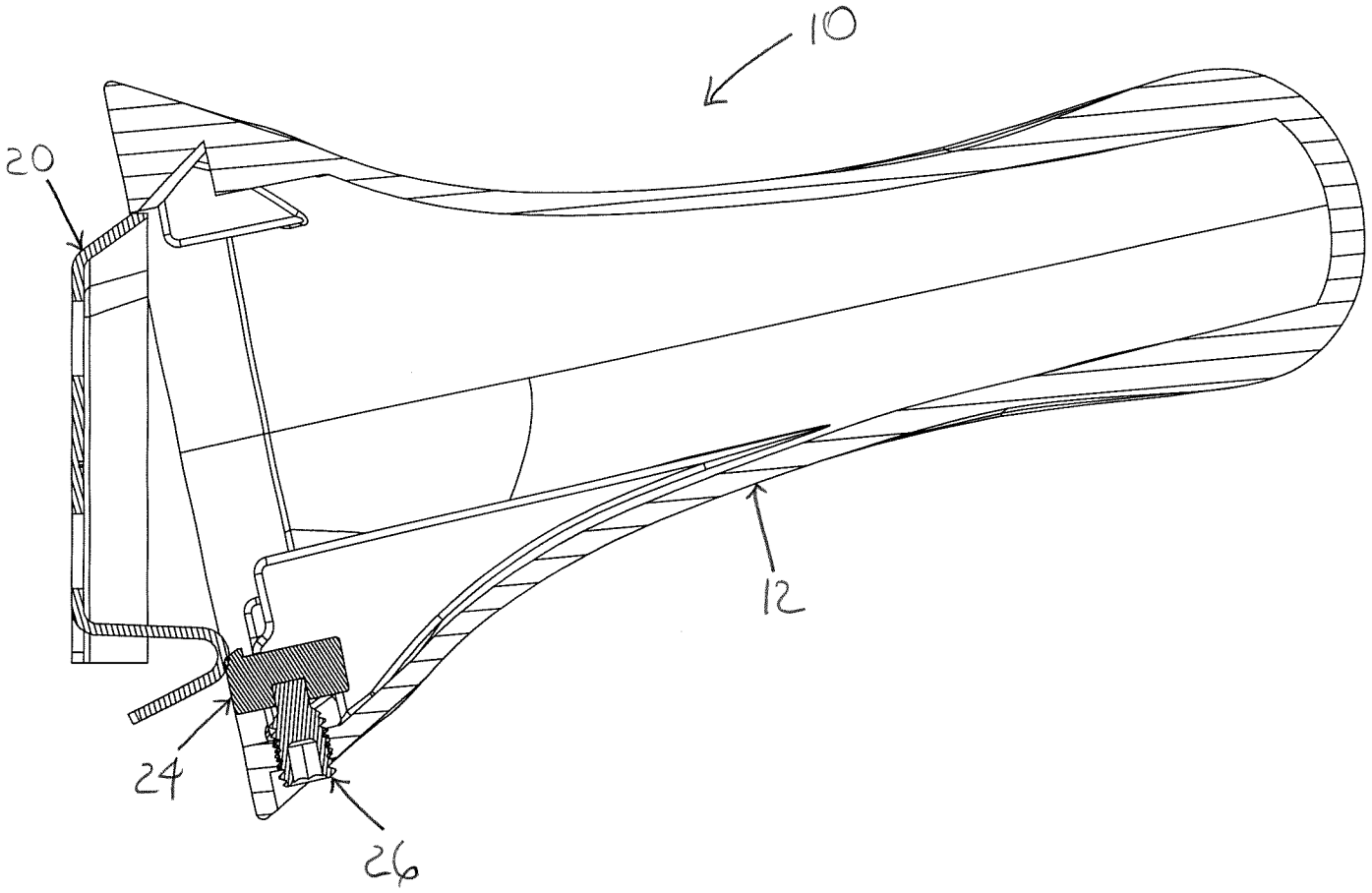
Figure 6C:
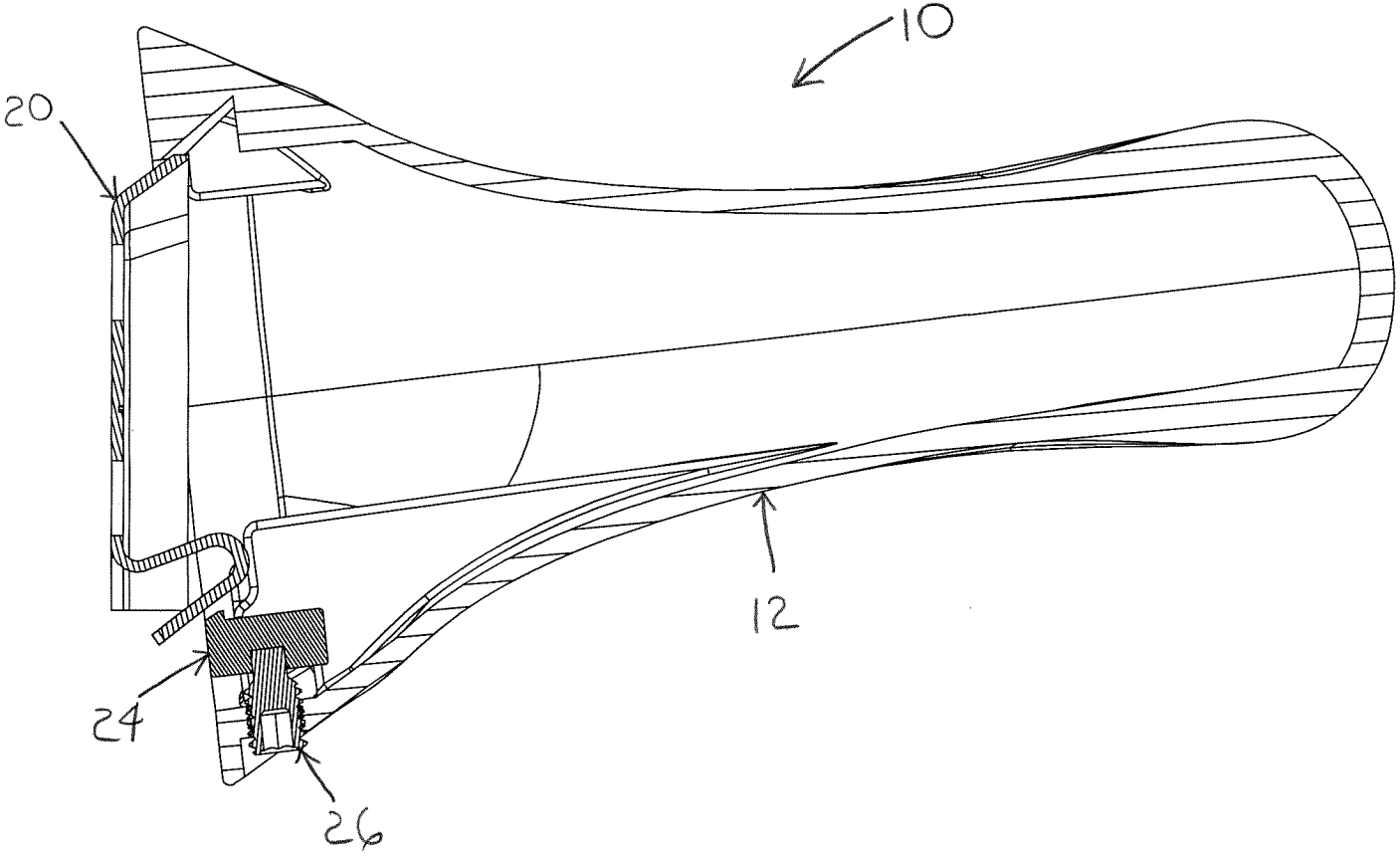
Figure 6D:
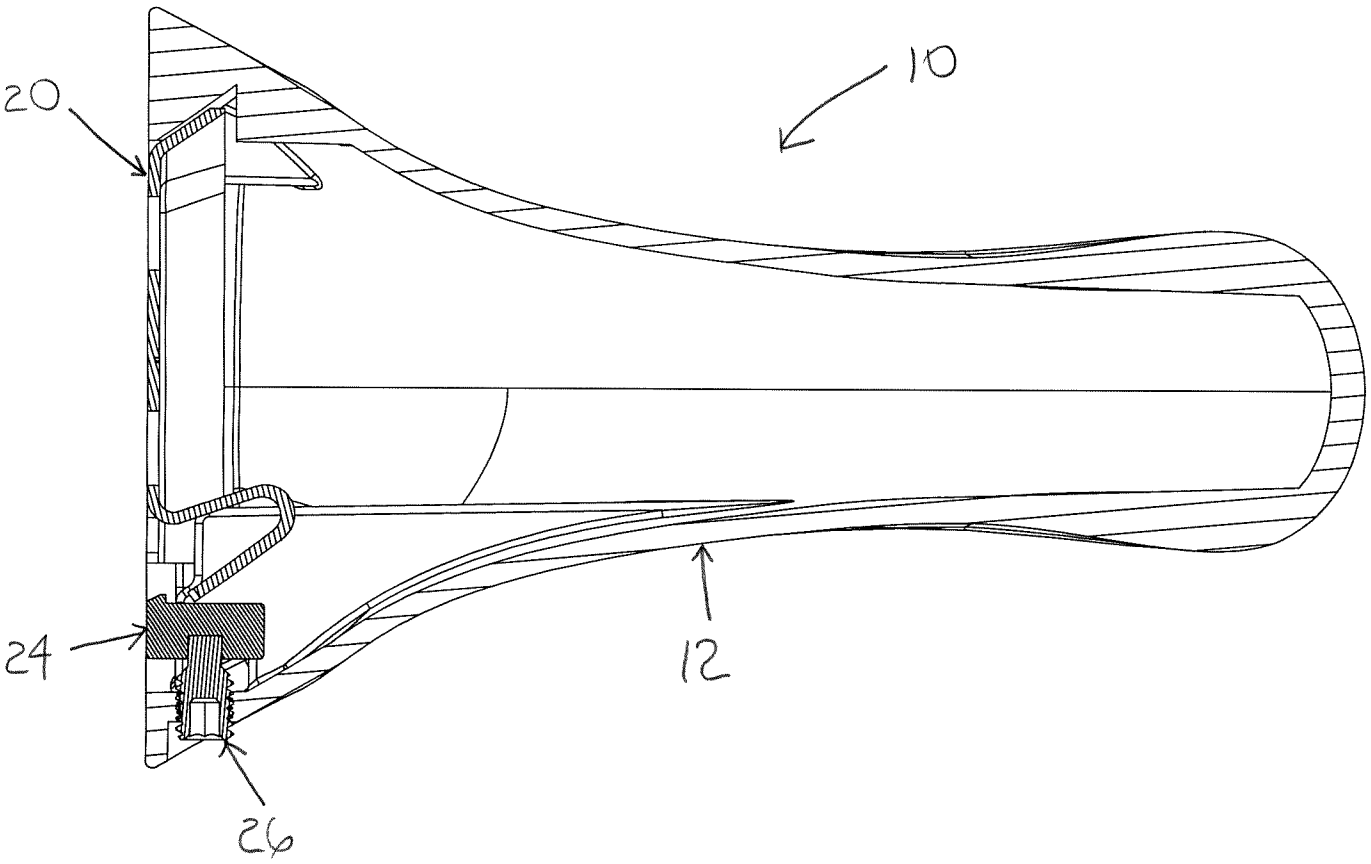

An exemplary embodiment of a mounting system 10 for an accessory of the present invention is shown in detail in FIGS. 1-6*d*. In an exemplary embodiment, the accessory mounting system 10 includes a post 12 and a mounting assembly 14. In an exemplary embodiment, the mounting assembly 14 includes a first mounting subassembly 16 and a second mounting subassembly 18. In the illustrated embodiment, the first mounting subassembly 16 includes a bracket 20 and mounting screws 22. In the illustrated embodiment, the second mounting subassembly 18 includes a brace 24 and a set screw 26.

An exemplary embodiment of the post 12 is shown in detail in FIGS. 3*a*-3*j*. In an exemplary embodiment, the post 12 is operable to be attached to a mounting surface by a snap engagement of the first mounting subassembly 16 with the second mounting subassembly 18. Additionally, the post 12 is operable to be removed from the mounting surface by unthreading the set screw 26 and disengagement of the first mounting subassembly 16 with the second mounting subassembly 18.

In an exemplary embodiment, the post 12 includes a front portion 28 and a rear portion 30. The front portion 28 of the post 12 includes a front opening 32. The front opening 32 is operable to receive a portion of an accessory, such as an end of a towel bar (not shown). In an exemplary embodiment, the rear portion 30 of the post 12 includes a rear opening 34 and a rear inner surface 36. The rear opening 34 is operable to receive the mounting assembly 14, including the first mounting subassembly 16 and the second mounting subassembly 18.

In an exemplary embodiment, the post 12 includes a top portion 38 and a bottom portion 40. In the illustrated embodiment, the top portion 38 of the post 12 adjacent to or near the rear opening 34 includes a notch 42 in the rear inner surface 36. The notch 42 angles radially outwardly from the rear opening 34. Additionally, the top portion 38 of the post 12 adjacent to or near the rear opening 34 includes two upper bracket ribs 44. The upper bracket ribs 44 extend radially inwardly from the rear inner surface 36 into the rear opening 34. One upper bracket rib 44 is located on each side of the notch 42. In the illustrated embodiment, the bottom portion 40 of the post 12 adjacent to or near the rear opening 34 includes a first set screw opening 46. In the illustrated embodiment, the first set screw opening 46 is threaded and cylindrical. Additionally, the bottom portion 40 of the post 12 adjacent to or near the rear opening 34 includes two brace ribs 48. The brace ribs 48 extend radially inwardly from the rear inner surface 36 into the rear opening 34. One brace rib 48 is located on each side of the first set screw opening 46. Further, the bottom portion 40 of the post 12 adjacent to or near the rear opening 34 includes two lower bracket ribs 50. The lower bracket ribs 50 extend radially inwardly from the rear inner surface 36 into the rear opening 34. One lower bracket rib 50 is located next to each brace rib 48.

An exemplary embodiment of the bracket 20 is shown in detail in FIGS. 4*a*-4*g*. In an exemplary embodiment, the bracket 20 is operable to be attached to the mounting surface. In an exemplary embodiment, the bracket 20 includes a base plate 52, a rim 54, and a deflectable member, such as a finger 56. The base plate 52 includes a front side 58, a rear side 60, a top side 62, a bottom side 64, a left side 66, and a right side 68. The base plate 52 includes two mounting openings 70 extending from the front side 58 through the rear side 60. The rim 54 includes a top side 72, a left side 74, and a right side 76. The left side 74, the top side 72, and the right side 76 of the rim 54 extend from the left side 66, the top side 62, and the right side 68 of the base plate 52, respectively. In the illustrated embodiment, the rim 54 angles outwardly from the base plate 52. The finger 56 extends from the bottom side 64 of the base plate 52. In the illustrated embodiment, the finger 56 is hook shaped. In an exemplary embodiment, the finger 56 is formed of a flexible material.

An exemplary embodiment of the brace 24 is shown in detail in FIGS. 5*a*-5*g*. In an exemplary embodiment, the brace 24 is operable to be secured to the post 12. In an exemplary embodiment, the brace 24 includes a central portion 78, two side portions 80, and a shoulder 82. The central portion 78 includes a front side 84, a rear side 86, a top side 88, a bottom side 90, a left side 92, and a right side 94. The bottom side 90 of the central portion 78 includes a second set screw opening 96 extending therein. In the illustrated embodiment, the second set screw opening 96 is smooth and cylindrical. One side portion 80 extends from each of the left side 92 and the right side 94 of the central portion 78. In the illustrated embodiment, the shoulder 82 extends from the top side 88 of the central portion 78 along the rear side 86 of the central portion 78.

An exemplary embodiment of the set screw 26 is shown in detail in FIGS. 1, 2, and 6*a*-6*d*. In an exemplary embodiment, the set screw 26 is operable to secure the brace 24 to the post 12. In an exemplary embodiment, the set screw 26 includes a first portion 98 and a second portion 100. In the illustrated embodiment, the first portion 98 is smooth and cylindrical. In the illustrated embodiment, the second portion 100 is threaded and cylindrical. The second portion 100 includes an opening 102 extending therein for receiving a screwdriver or other tool.

In an exemplary embodiment, the accessory is assembled and installed on the mounting surface, such as a wall. Exemplary assembly and installation steps will be described.

During assembly, the brace 24 is secured to the post 12. More specifically, the brace 24 is inserted through the rear opening 34 in the rear portion 30 of the post 12 until the side portions 80 of the brace 24 abut the brace ribs 48 of the bottom portion 40 of the post 12. The set screw 26 is threaded into the first set screw opening 46 in the bottom portion 40 of the post 12 until the first portion 98 of the set screw 26 is received in the second set screw opening 96 in the bottom side 90 of the central portion 78 of the brace 24. The brace 24 is held in place between the set screw 26 and the brace ribs 48 of the bottom portion 40 of the post 12. The post 12 is now assembled.

During installation, the bracket 20 is attached to the mounting surface, and the post 12 is attached to the bracket 20. More specifically, the bracket 20 is attached to the mounting surface via the mounting screws 22 extending through the mounting openings 70 in the base plate 52 of the bracket 20 and into the mounting surface. The top portion 38 of the post 12 is placed over the top side 72 of the rim 54 of the bracket 20 such that the top side 72 of the rim 54 of the bracket 20 is received in the notch 42 in the top portion 38 of the post 12. The bottom portion 40 of the post 12 is pushed toward the mounting surface until the rear portion 30 of the post 12 is flush against the mounting surface. As the bottom portion 40 of the post 12 moves toward the mounting surface, the finger 56 of the bracket 20 deflects upwardly and moves past the shoulder 82 of the brace 24 creating a snap engagement. Once the post 12 is flush against the mounting surface, the engagement of the finger 56 of the bracket 20 with the top side 88 of the central portion 78 of the brace 24 maintains the post 12 in place. The post 12 is now installed on the mounting surface.

Once the post 12 is installed on the mounting surface, the engagement of the bracket 20 with the post 12 and the brace 24 securely retains the post 12 on the mounting surface and prevents the post 12 from being easily removed from the mounting surface. More specifically, the engagement of the top side 72 of the rim 54 of the bracket 20 with the notch 42 in the top portion 38 of the post 12 and the snap engagement of the finger 56 of the bracket 20 with the top side 88 of the central portion 78 and the shoulder 82 of the brace 24 prevent the post 12 from being easily removed from the mounting surface. Additionally, the engagement of the bracket 20 with the post 12 prevents the post 12 from rotating on the mounting surface. More specifically, the engagement of the bracket 20 with the upper bracket ribs 44 and the lower bracket ribs 50 of the post 12 prevents the post 12 from rotating on the mounting surface.

In an exemplary embodiment, the accessory can be uninstalled from the mounting surface. Exemplary uninstallation steps will be described.

The set screw 26 is threaded out of the first set screw opening 46 in the bottom portion 40 of the post 12 until the first portion 98 of the set screw 26 is no longer received in the second set screw opening 96 in the bottom side 90 of the central portion 78 of the brace 24. The set screw 26 can also be threaded out of the first set screw opening 46 in the bottom portion 40 of the post 12 until the set screw 26 is no longer received in the first set screw opening 46 in the bottom portion 40 of the post 12. The brace 24 is no longer held in place between the set screw 26 and the brace ribs 48 of the bottom portion 40 of the post 12 so the finger 56 of the bracket 20 will no longer be prevented from moving past the shoulder 82 of the brace 24. The bottom portion 40 of the post 12 can be easily moved away from the mounting surface until the finger 56 of the bracket 20 moves along the top side 88 of the central portion 78 of the brace 24 and past the shoulder 82 of the brace 24. The top portion 38 of the post 12 can be easily moved away from the mounting surface so that the top side 72 of the rim 54 of the bracket 20 is no longer received in the notch 42 in the top portion 38 of the post 12. The post 12 is now uninstalled from the mounting surface.

In describing the components of the accessory mounting system 10 and the assembly, installation, and uninstallation of the accessory to and from the mounting surface, terms describing the orientation of the components of the accessory mounting system 10 are used. For example, the post 12 is described as having a front portion 28 and a rear portion 30. Similarly, the post 12 is described as having a top portion 38 and a bottom portion 40. These terms describe the components of the accessory mounting system 10 as oriented in the drawings. However, one of ordinary skill in the art will appreciate that the accessory mounting system 10 could be oriented in any direction and that these terms are relative terms and are merely used for ease of reference in describing the components of the accessory mounting system 10 and the assembly, installation, and uninstallation of the accessory to and from the mounting surface.

While the assembly, installation, and uninstallation steps have been described above in a particular order, one of ordinary skill in the art will appreciate that these steps do not need to be performed in this particular order.

For example, while the step of securing the brace 24 to the post 12 has been described before the step of attaching the bracket 20 to the mounting surface, one of ordinary skill in the art will appreciate that these steps could be reversed.

While the accessory mounting system 10 has been shown and described in the illustrated embodiment as including certain components, one of ordinary skill in the art will appreciate that the accessory mounting system 10 does not need to include each of these components and/or the specifics of each of these components.

For example, while the second mounting subassembly 18 has been shown and described as including the brace 24, one of ordinary skill in the art will appreciate that the second mounting subassembly 18 does not need to include the brace 24. Instead, the set screw 26 could directly snap engage the deflectable member, such as the finger 56, of the first mounting subassembly 16.

While the accessory mounting system 10 has been shown and described in the illustrated embodiment with the components attached in a particular manner, one of ordinary skill in the art will appreciate that the components of the accessory mounting system 10 do not need to be attached in this particular manner.

For example, while the bracket 20 has been shown and described as being attached to the mounting surface via the mounting screws 22, one of ordinary skill in the art will appreciate that other attachment mechanisms could be used.

One of ordinary skill in the art will now appreciate that the present invention provides a mounting system for an accessory that enables a consumer to easily install and uninstall the accessory on a mounting surface. Although the present invention has been shown and described with reference to a particular embodiment, equivalent alterations and modifications will occur to those skilled in the art upon reading and understanding this specification. The present invention includes all such equivalent alterations and modifications.

What is claimed is:

1. An accessory mounting system, comprising:

a post, the post operable to be installed on a mounting surface, the post including:

a rear opening; and a first set screw opening; and a mounting assembly, the mounting assembly operable to be received in the rear opening in the post, the mounting assembly including:

a first mounting subassembly, the first mounting subassembly including a deflectable member; and a second mounting subassembly, the second mounting subassembly including a set screw;

wherein the set screw is operable to be threaded through the first set screw opening in the post and into the rear opening in the post;

wherein the first mounting subassembly is operable to be attached to the mounting surface;

wherein the post is operable to be attached to the mounting surface by an engagement of the first mounting subassembly with the post and a snap engagement of the deflectable member of the first mounting subassembly with the second mounting subassembly; and wherein the post is operable to be removed from the mounting surface by disengagement of the deflectable member of the first mounting subassembly with the second mounting subassembly and disengagement of the first mounting subassembly with the post.

2. The accessory mounting system of claim 1, wherein:

the first mounting subassembly includes a bracket; and the bracket is operable to be attached to the mounting surface and to engage the post.

3. The accessory mounting system of claim 2, wherein:

the bracket includes a base plate; and the base plate is operable to be attached to the mounting surface.

4. The accessory mounting system of claim 2, wherein:

the post includes a notch;

the bracket includes a rim; and the rim of the bracket is operable to be received in the notch in the post.

5. The accessory mounting system of claim 2, wherein:

the bracket includes the deflectable member;

the deflectable member includes a finger; and the finger is operable to snap engage the second mounting subassembly.

6. The accessory mounting system of claim 1, wherein:

the second mounting subassembly includes a brace;

the brace is operable to be secured to the post; and the brace is operable to engage the deflectable member of the first mounting subassembly.

7. The accessory mounting system of claim 6, wherein:

the brace includes a shoulder; and the deflectable member of the first mounting subassembly is operable to snap engage the shoulder of the brace.

8. The accessory mounting system of claim 6, wherein:

the post includes brace ribs; and the brace ribs are operable to abut the brace.

9. The accessory mounting system of claim 2, wherein:

the post includes bracket ribs; and the bracket ribs are operable to abut the bracket.

10. An accessory mounting system, comprising:

a post, the post operable to be installed on a mounting surface, the post including:

a rear opening; and a first set screw opening; and a mounting assembly, the mounting assembly operable to be received in the rear opening in the post, the mounting assembly including:

a first mounting subassembly, the first mounting subassembly including a bracket;

the bracket including a base plate and a deflectable member; and a second mounting subassembly, the second mounting subassembly including a set screw;

wherein the set screw is operable to be threaded through the first set screw opening in the post and into the rear opening in the post;

wherein the bracket is operable to be attached to the mounting surface;

wherein the post is operable to be attached to the mounting surface by an engagement of the bracket with the post and a snap engagement of the deflectable member of the bracket with the second mounting subassembly; and wherein the post is operable to be removed from the mounting surface by disengagement of the deflectable member of the bracket with the second mounting subassembly and disengagement of the bracket with the post.

11. The accessory mounting system of claim 10, wherein:

the post includes a notch;

the bracket includes a rim; and the rim of the bracket is operable to be received in the notch in the post.

12. The accessory mounting system of claim 10, wherein:

the bracket includes the deflectable member;

the deflectable member includes a finger; and the finger is operable to snap engage the second mounting subassembly.

13. The accessory mounting system of claim 10, wherein:

the second mounting subassembly includes a brace;

the brace is operable to be secured to the post; and the brace is operable to engage the deflectable member of the first mounting subassembly.

14. The accessory mounting system of claim 13, wherein:

the brace includes a shoulder; and the deflectable member of the first mounting subassembly is operable to snap engage the shoulder of the brace.

15. The accessory mounting system of claim 13, wherein:

the post includes brace ribs; and the brace ribs are operable to abut the brace.

16. The accessory mounting system of claim 10, wherein:

the post includes bracket ribs; and the bracket ribs are operable to abut the bracket.

17. An accessory mounting system, comprising:

a post, the post operable to be installed on a mounting surface, the post including:

a rear opening;

a rear inner surface;

a notch in the rear inner surface; and a first set screw opening; and a mounting assembly, the mounting assembly operable to be received in the rear opening in the post, the mounting assembly including:

a first mounting subassembly, the first mounting subassembly including a bracket;

the bracket including a base plate, a rim, and a finger; and a second mounting subassembly, the second mounting subassembly including a brace and a set screw;

the brace including a second set screw opening;

wherein the set screw is operable to be threaded through the first set screw opening in the post and into the rear opening in the post;

wherein the brace is operable to be secured to the post by engagement of the set screw with the second set screw opening in the brace;

wherein the bracket is operable to be attached to the mounting surface;

wherein the post is operable to be attached to the mounting surface by an engagement of the rim of the bracket with the notch in the rear inner surface of the post and a snap engagement of the finger of the bracket with the brace; and wherein the post is operable to be removed from the mounting surface by disengagement of the set screw with the second set screw opening in the brace, disengagement of the finger of the bracket with the brace, and disengagement of the rim of the bracket with the notch in the rear inner surface of the post.

18. The accessory mounting system of claim 17, wherein:

the brace includes a shoulder; and the finger of the bracket is operable to snap engage the shoulder of the brace.

19. The accessory mounting system of claim 17, wherein:

the post includes brace ribs; and the brace ribs are operable to abut the brace.

20. The accessory mounting system of claim 17, wherein:

the post includes bracket ribs; and the bracket ribs are operable to abut the bracket.

* * * * *